US008646875B2

(12) United States Patent
Gulvin et al.

(10) Patent No.: US 8,646,875 B2
(45) Date of Patent: Feb. 11, 2014

(54) INDEPENDENT ADJUSTMENT OF DROP MASS AND VELOCITY USING STEPPED NOZZLES

(75) Inventors: Peter M. Gulvin, Webster, NY (US); John R. Andrews, Fairport, NY (US); Gerald A. Domoto, Briarcliff Manor, NY (US); Nicholas P. Kladias, Flushing, NY (US); Peter J. Nystrom, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 251 days.

(21) Appl. No.: 12/751,077

(22) Filed: Mar. 31, 2010

(65) Prior Publication Data

US 2011/0242218 A1 Oct. 6, 2011

(51) Int. Cl.
*B41J 2/14* (2006.01)
*B41J 2/16* (2006.01)

(52) U.S. Cl.
USPC ..... 347/47; 29/890.1

(58) Field of Classification Search
USPC ..... 347/47; 29/890.1
See application file for complete search history.

(56) References Cited

U.S. PATENT DOCUMENTS 5,818,478 A * 10/1998 Gibson ..... 347/45
6,474,784 B1 * 11/2002 Fujii et al. ..... 347/54
2010/0238215 A1 * 9/2010 Kusunoki ..... 347/10

FOREIGN PATENT DOCUMENTS

JP 09216368 A * 8/1997

* cited by examiner

*Primary Examiner* — Lisa M Solomon
(74) *Attorney, Agent, or Firm* — MH2 Technology Law Group LLP

(57) ABSTRACT

Methods and systems of ejecting ink drops from an inkjet printer are disclosed. The methods and systems can include a printhead with one or more stepped nozzles each with an associated entrance diameter and exit diameter. Ink can be received into the printhead and formed into ink drops in the stepped nozzles. The ink drops can each have an associated drop mass and drop speed. The stepped nozzles can be provided such that the exit diameter can independently dictate the drop mass and the entrance diameter can independently dictate the drop speed. As such, the complexity of jet design optimization is reduced.

8 Claims, 4 Drawing Sheets

D_back=25um

D_back=30um

D_back=35um

D_back=40um

D_back=45um

D_back=50um

INDEPENDENT ADJUSTMENT OF DROP MASS AND VELOCITY USING STEPPED NOZZLES

FIELD OF THE INVENTION

The present invention generally relates to independent adjustment of ink drop mass and ink drop velocity using defined nozzle diameters in a stepped nozzle in an inkjet printhead. More specifically, with an exit portion of a nozzle having a smaller diameter than an entrance portion of the nozzle, and a predetermined difference in diameter therebetween, the exit diameter can dictate the size of the ejected drop, and the entrance diameter can dictate the drop speed.

BACKGROUND OF THE INVENTION

In a conventional inkjet printer, a printhead has a series of droplet apertures or nozzles out of which the printing fluid or ink ejects to an image receiving substrate. Each nozzle can have a corresponding actuator for ejecting the ink through the nozzle. The ink drop mass, or size, and drop speed, or velocity, can influence the quality of the printing. For example, the drop mass and speed can affect drop placement and satellite formation. In inkjet printers with a constant diameter (cylindrical) nozzle, both the ejected ink drop mass and drop speed are dependent on nozzle diameter. For example, an increase in nozzle diameter increases both the drop mass and drop speed of the ejected ink. As such, complicated design optimizations are undertaken to attempt to obtain an acceptable drop speed in conjunction with a desired drop mass.

As are known in the art, conventional tapered, or conical, nozzles can be used instead of cylindrical nozzles. The exit diameter of the conventional tapered nozzle, or the point at which the ink drop exits the nozzle, can be used to adjust drop mass. Further, the conventional tapered nozzle can increase drop speed and improve alignment tolerances. However, conventional tapered nozzle designs cannot maintain independent control of both the drop mass and the drop speed.

In liquid droplet ejecting devices with a constant diameter aperture (cylindrical nozzle) both the ejected drop size and drop speed are dependent on the aperture diameter. The aperture diameter is a commonly known element used to adjust the drop mass. The high degree of correlation in the drop mass and drop velocity means that complicated design optimizations involving many of the single jet parameters must be undertaken to obtain an acceptable drop velocity simultaneous with the desire drop mass. It would, therefore, be desirable to separate the adjustment in drop mass form the adjustment in drop velocity.

Thus, there is a need for a stepped nozzle design which can control the ink drop mass independently of the drop speed and reduce the need for complicated design optimizations.

SUMMARY OF THE INVENTION

In accordance with the present teachings, an inkjet printing system is provided. The system comprises a printhead configured to receive ink and at least one stepped nozzle, wherein the at least one stepped nozzle comprises an exit diameter configured to control a mass of an ejected ink drop, and an entrance diameter configured to control a speed of the ejected ink drop independently from the mass of the ejected ink drop.

In accordance with the present teachings, an inkjet printhead system is provided. The system comprises a printhead comprising at least one stepped nozzle, wherein the at least one stepped nozzle comprises an exit diameter configured to control a mass of an ink drop, wherein the exit diameter is in a range of about 5 μm to about 45 μm, and an entrance diameter configured to control a speed of the ink drop independently from the mass of the ink drop, wherein the entrance diameter is greater than about 35 μm.

In accordance with the present teachings, a method for forming a printhead nozzle is provided. The method comprises providing a printhead comprising at least one stepped nozzle configured to eject an ink drop from the printhead. Further, the method comprises setting an exit diameter of the at least one stepped nozzle to dictate a mass of the ejected ink drop. Still further, the method comprises setting an entrance diameter of the at least one stepped nozzle to dictate a speed of the ejected ink drop independent from the mass of the ejected ink drop.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Figure 1:
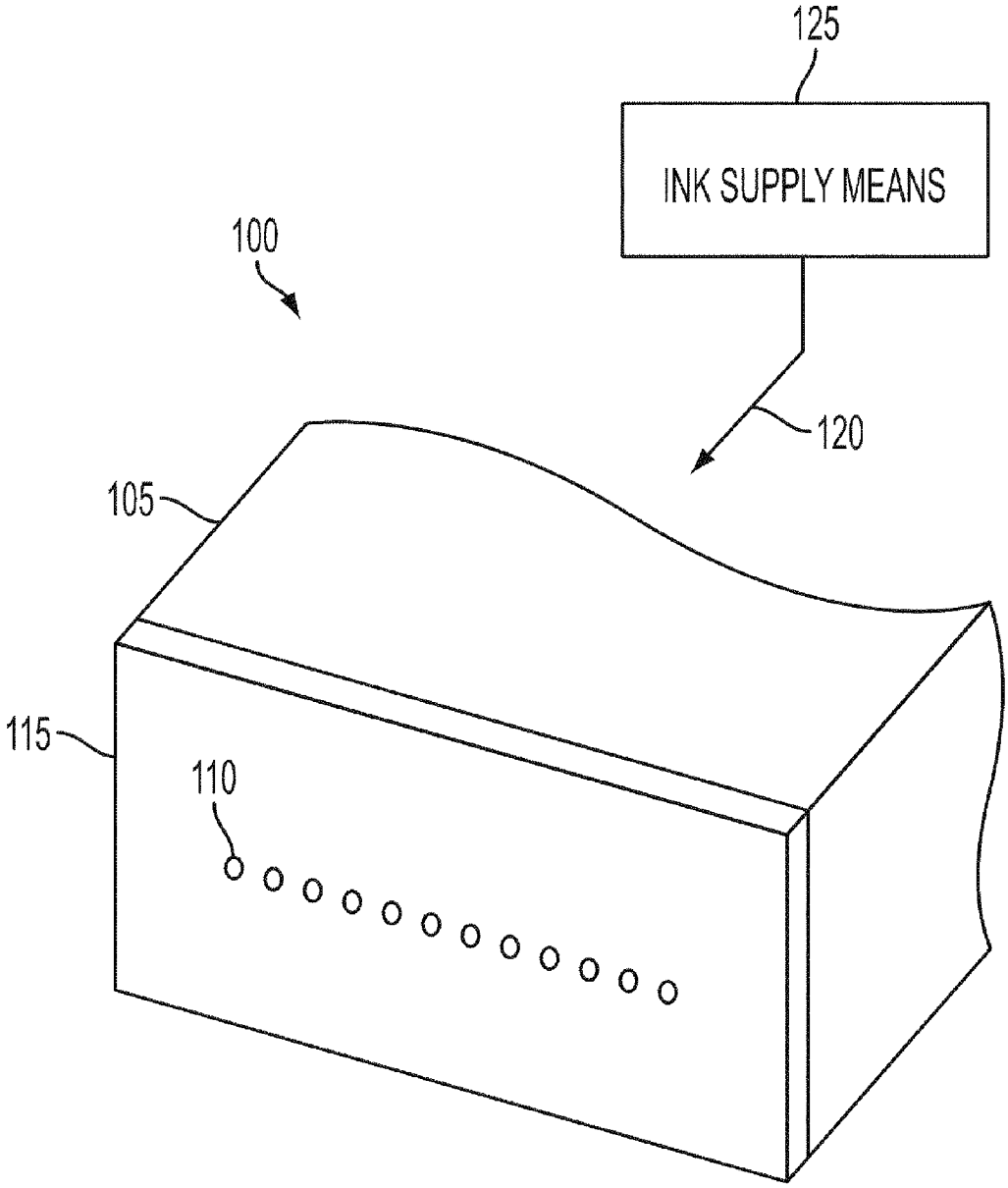
FIG. 1 depicts an exemplary ink delivery system of an inkjet printer according to the present teachings.

Reference will now be made in detail to the exemplary embodiments of the invention, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

It should be appreciated that the exemplary systems and methods depicted in FIGS. 1-7 can be employed for any inkjet printer where ink is delivered through a nozzle or aperture to an image receiving substrate, for example for piezo inkjet and solid ink systems as known in the art. The ink can be delivered through a printhead or a similar component. The exemplary systems and methods describe a stepped nozzle with distinct dimensions at an entrance and exit of the nozzle, to control ink drop mass independent from ink drop speed.

The exemplary systems and methods can have a printhead comprising at least one stepped nozzle through which the ink can exit the printhead. The stepped nozzle can include a larger diameter entrance and a relatively smaller diameter exit in the direction of the ink jetting, or ejecting. The dimensions of the stepped nozzle can be designed such that the drop mass and the drop speed of the ejected ink can be adjusted independently. Specifically, the stepped nozzle can have an exit with an associated exit diameter, and an entrance with an associated entrance diameter. The exit diameter can be adjusted to control the drop mass of the ejected ink drops, and the entrance diameter can be adjusted to control the drop speed of the ejected drops. Further, the exit diameter and entrance diameter can respectively control the drop mass and the drop speed of the ejected ink drops independently of each other.

The independent control of the drop mass and drop speed described by the present systems and methods can reduce the complexity of single jet design optimization in a global design space while still realizing optimal drop mass and drop speed measurements. For example, the present methods and systems can employ entrance diameters of greater than about 35 μm (or from about 35 to about 50 μm) that can permit adjustment of the drop speed in the range of about 3 to about 15 m/s, or about 11 meters/second (m/s). Further, for example, the present methods and systems can employ exit diameters of about 25 μm that can permit adjustment of the drop mass in the range of about 5-25 picoliter (pL), and about 13 pL. It should be appreciated that other ranges of entrance diameters and exit diameters can respectively permit adjustment of drop speed and drop mass in other ranges depending on the inkjet printer, the printhead, the type and properties of the ink used, the comprising materials, and other factors.

FIG. 1 depicts an exemplary ink delivery system of an inkjet printer. The system can include a printhead 100 with a main body 105 having a plurality of ink carrying channels (not shown in FIG. 1). In various embodiments, the plurality of ink carrying channels can be cylindrical and can run parallel to each other. The plurality of ink carrying channels can receive ink from an ink supply 125, which can provide ink through the plurality of ink carrying channels in the direction indicated by 120. The ink from the ink supply 125 can be any ink capable of being used in an inkjet printer. For example, the ink can have a viscosity of approximately 10 centipoise (cP), or other ranges and values.

The printhead 100 can further include a nozzle plate 115 connected to an end of the main body 105. The nozzle plate 115 can have a plurality of nozzles 110 extending therethrough. The nozzle plate 115 can be connected to the main body 105 such that each of the plurality of nozzles 110 can be in line and in connection with a corresponding ink carrying channel. As such, the ink from the ink carrying channels can be carried from the ink supply 125 and be ejected through the corresponding nozzles of the plurality of nozzles 110. It should be appreciated that the printhead 100 and the respective components of the printhead 100 can vary in size and functionality. For example, the ink can be received, transported, and ejected via other various components and methods.

Figure 2:
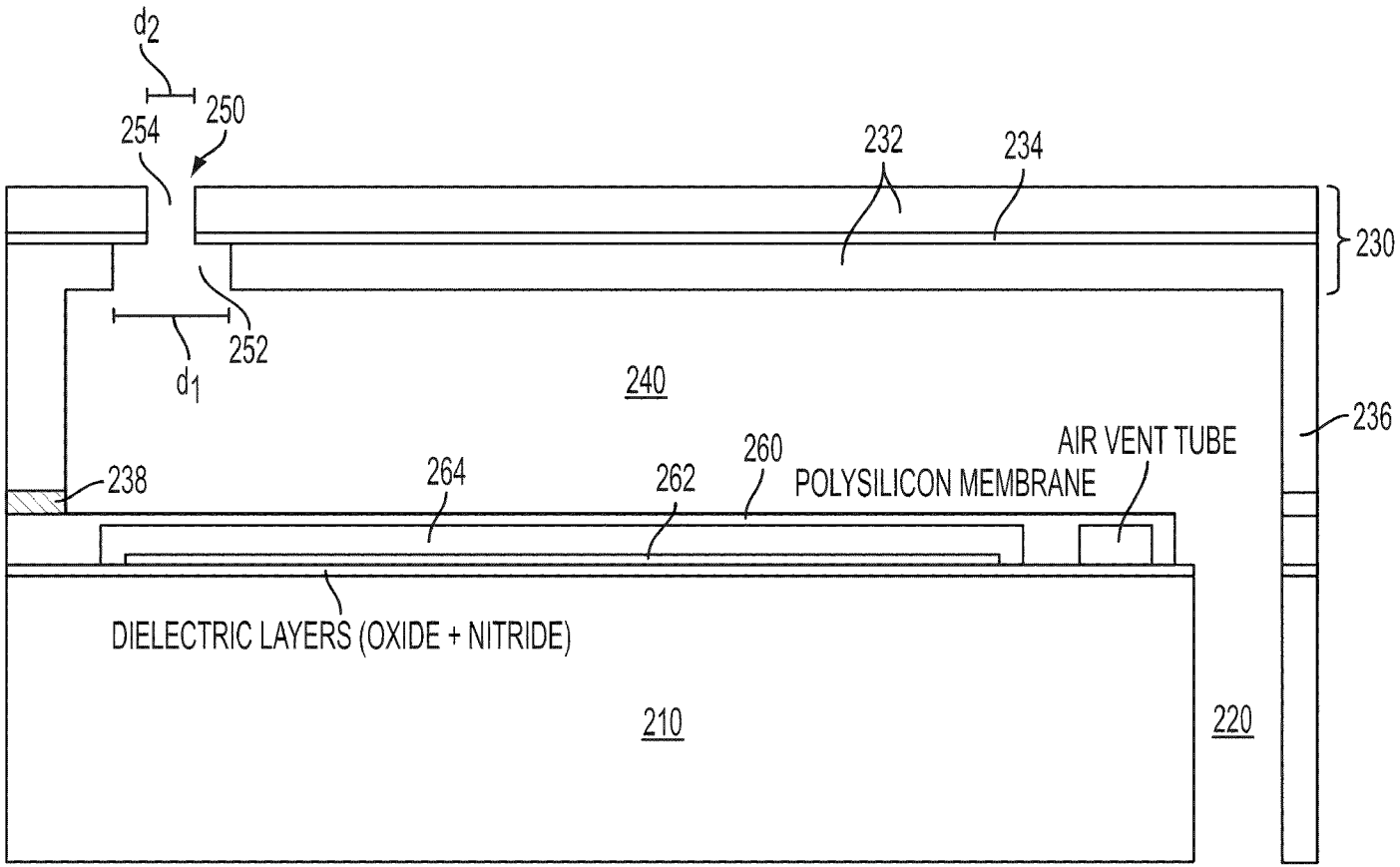
FIG. 2 is a side sectional view depicting an exemplary printhead having a stepped nozzle according to the present teachings.

FIG. 2 depicts a side sectional view of an exemplary printhead 200 in accordance with the present teachings. It should be readily apparent to one of ordinary skill in the art that the ink jet printhead 200 depicted in FIG. 2 represents a generalized schematic illustration and that other components can be added or existing components can be removed or modified.

As shown in FIG. 2, the ink jet printhead 200 can be an electrostatically actuated print head. The printhead 200 can include a substrate 210, an ink passage 220 through the substrate 210, a nozzle plate 230 mounted on the substrate 210 by sidewalls 236 at a spacing defining an ink cavity 240 between the nozzle plate 230 and the substrate 210. The side walls 236 can be connected to the substrate 210 by a bonding metal 238 or the like. The nozzle plate 230 can include a stepped nozzle 250 having an entrance 252 and an exit 254, each with a corresponding diameter d1 and d2, respectively. An electrostatically actuated membrane 260 can be formed on the substrate 210 as shown.

In the print head, the membrane 260 can be an electrostatically actuated diaphragm, in which the membrane is controlled by an electrode 262. The membrane 260 can be made from a structural material such as polysilicon, as is typically used in a surface micromachining process. Although not shown, a dimple can be attached to a part of the membrane 260 and act to separate the membrane 260 from the electrode 262 when the membrane is pulled down towards the electrode under electrostatic attraction (e.g. when a voltage or current is applied between the membrane and the electrode). An actuator chamber 264 between membrane 260 and substrate 210 can be formed using typical techniques, such as by surface micromachining. The electrode 2262 acts as a counter electrode and is typically either a metal or a doped semiconductor film such as polysilicon.

The nozzle plate 230 is located above the electrostatically actuated membrane 260, forming the ink cavity 240 between the nozzle plate 230 and the membrane 260. The nozzle plate 230 can include a silicon on insulator (SOI) wafer structure, in which silicon dioxide 234 is sandwiched between silicon layers 232. Each of the silicon layers can be 12.5 μm in thickness and in combination define an overall nozzle plate thickness of about 25 μm.

Nozzle plate 230 has the stepped nozzle 250 formed therein. Fluid is fed into the ink cavity 240 from a fluid reservoir (for example ink supply means 125 of FIG. 1) via the ink passage 220. The ink cavity 240 can be separated from the fluid reservoir 135 by a check valve to restrict fluid flow from the fluid reservoir to the ink cavity. The membrane 260 is initially pulled down by an applied voltage or current. Fluid fills in the volume of the ink cavity 240 created by the membrane deflection.

When a bias voltage or charge is eliminated, the membrane 260 relaxes, increasing the pressure in the ink cavity 240. As the pressure increases, fluid is forced out of nozzle 250 formed in the nozzle plate 230, as discrete fluid drops. For constant volume or constant drop size fluid ejection, the membrane 260 can be actuated using a voltage drive mode, in which a constant bias voltage is applied between the parallel plate conductors that form the membrane and the conductor.

Referring now to the nozzle plate 230 in further detail, the stepped nozzle 250 can include an entrance 252 and an exit 254. In various embodiments, ink can flow into the entrance 252 and exit through the exit 254. For example, ink can enter the entrance 252 from the ink cavity 240 and can exit the exit 254 as a sequence of one or more drops after the ink is pushed through the stepped nozzle 250.

In the stepped nozzle 250, the exit 254 has a smaller diameter than the entrance 252. As long as the difference in diameter between the entrance 252 and the exit 254 is substantial enough, there is a region of design space where the exit diameter will dictate the size of the ejected drop, and the entrance diameter will dictate the drop speed. Even further, optimizing can be achieved when the exit diameter is chosen to obtain the desired drop size (one where the plot levels out at the desired value), and then the entrance diameter is chosen to achieve the desired drop speed. By using two degrees of freedom (stepped nozzle entrance and exit diameters), complexity in optimizing a single jet design can be reduced, allowing devices that have a desired drop mass and drop velocity. This is in contrast to the way designs are typically chosen, using one degree of freedom (nozzle diameter); so that either drop size or drop speed can be chosen, but not both.

In certain embodiments, a diameter d1 of the entrance 252 can be in a range of about 25 μm to about 60 μm. Further, a diameter d2 of the exit 254 can be about 10 μm to about 45 μm. The nozzle plate 230 can have a thickness of about 25 μm. It should, however, be appreciated that the exit diameter d2, the entrance diameter d1, and the thickness can each have a different range of values. For example, the exit diameter d2, the entrance diameter d1, and nozzle plate thickness can each vary depending on the nozzle plate 230, the printhead, the printer, the comprising materials, the type of ink used, and other factors. For exit diameters of 25 μm and entrance diameters of greater than 35 μm, the drop velocity goes up roughly in proportion to the entrance diameter, whereas the drop mass is nearly independent of the entrance diameter.

The different values and adjustments among the exit diameter d2 and the entrance diameter d1 can influence the drop mass and drop speed of the ink drops that can exit the stepped nozzle 250. Further, the different values and adjustments among the exit diameter d2, and the entrance diameter d1 can allow for the drop mass and drop speed to be independently controlled.

Figure 3A:
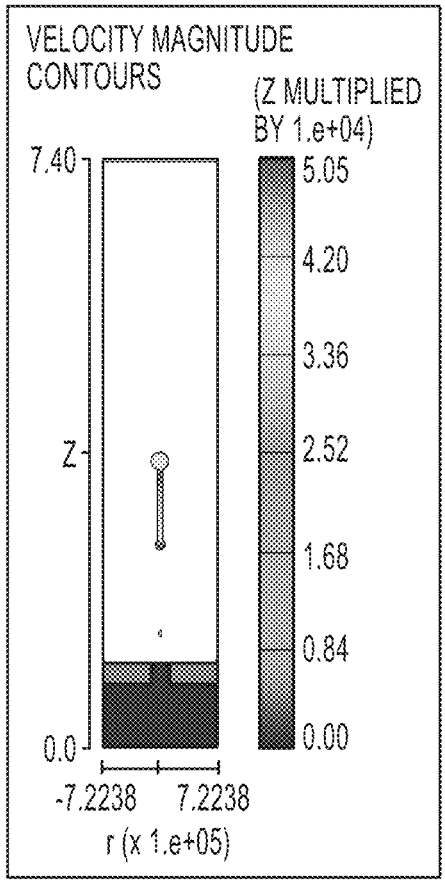
FIG. 3A is a graph depicting the mass and speed of an ink drop ejecting from a cylindrical nozzle according to the present teachings.
Figure 3B:
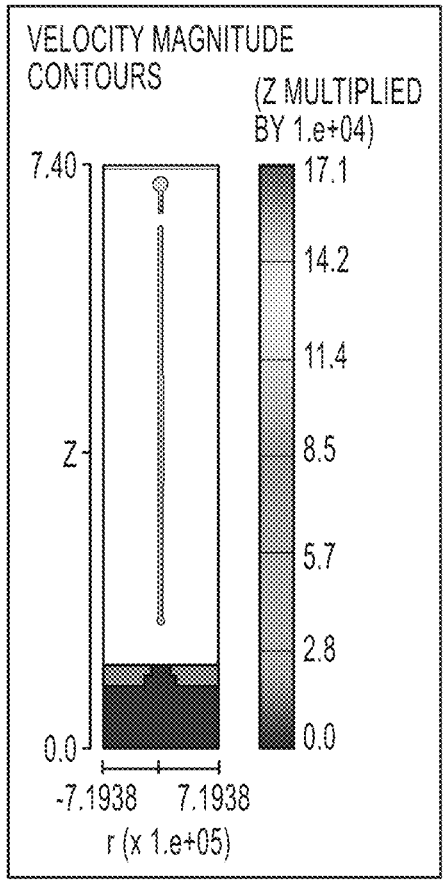
FIG. 3B is a graph depicting the mass and speed of an ink drop ejecting from a stepped nozzle according to the present teachings.
Figure 4A:
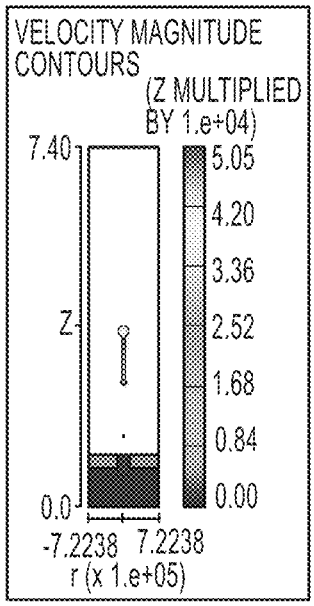
FIG. 4A is a graph depicting the speed of an ink drop ejecting from a stepped nozzle according to the present teachings.
Figure 4B:
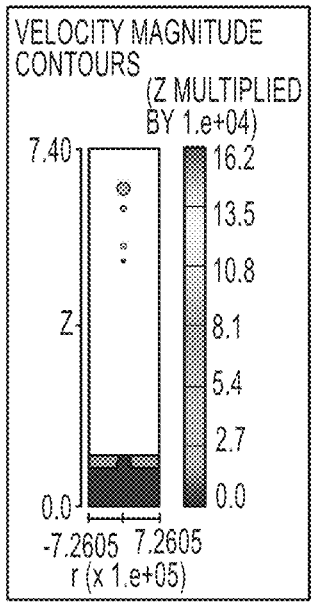
FIG. 4B is a graph depicting the speed of an ink drop ejecting from a stepped nozzle according to the present teachings.
Figure 4C:
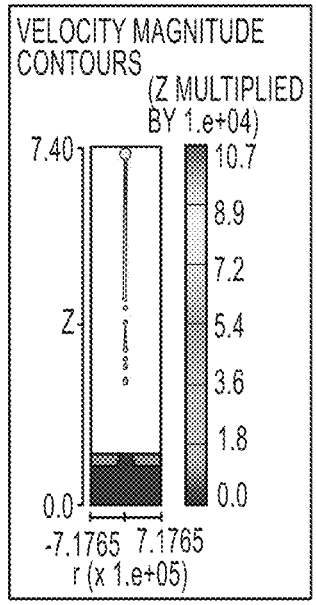
FIG. 4C is a graph depicting the speed of an ink drop ejecting from a stepped nozzle according to the present teachings.
Figure 4D:
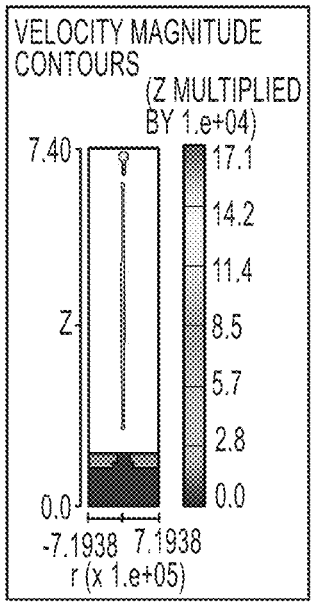
FIG. 4D is a graph depicting the speed of an ink drop ejecting from a stepped nozzle according to the present teachings.
Figure 4E:
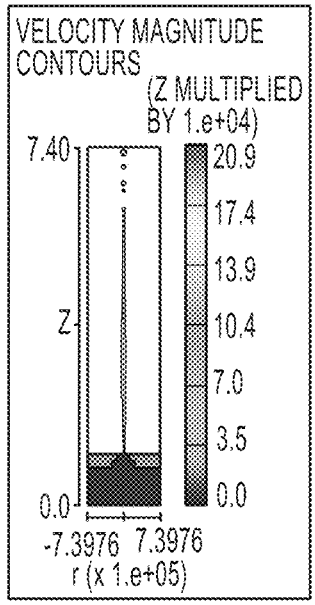
FIG. 4E is a graph depicting the speed of an ink drop ejecting from a stepped nozzle according to the present teachings.
Figure 4F:
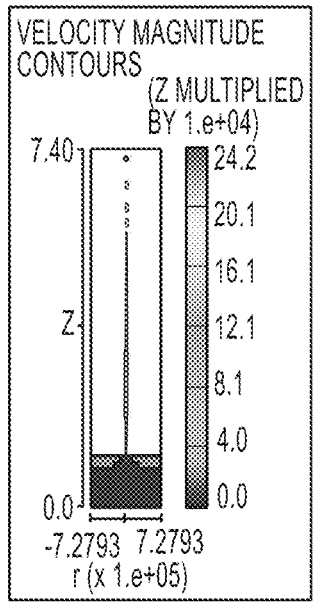
FIG. 4F is a graph depicting the speed of an ink drop ejecting from a stepped nozzle according to the present teachings.

FIGS. 3A and 3B are graphs depicting the volume and speed of an ink drop after ejecting from a cylindrical (non-stepped) nozzle and a stepped nozzle, respectively. The results depicted in FIGS. 3A and 3B were obtained when a 200 Volt, 6 us square wave was applied to an electrostatic inkjet actuator. The ejecting drops were modeled using a commercially available computational fluid dynamics (CFD) code, Flow3D. Two test cases, (a) and (b), as respectively depicted in FIG. 3A and FIG. 3B, were conducted. Test case (a) utilized a 25 μm diameter cylindrical nozzle, and test case (b) utilized a stepped nozzle having a 40 μm diameter entrance and a 25 μm diameter exit. In both test cases, the length of the cylindrical nozzle was 25 μm. The vertical scale bars in both test cases depict the speed of the ejected drop after passage through the respective cylindrical nozzle.

In test case (a), after passage through the cylindrical nozzle, the ejected drop had a speed of 3.5 m/s. Further, the mass of the ejected drop in test case (a) was 8.2 pL. In test case (b), after passage through the stepped nozzle, the ejected drop had a speed of 11.8 m/s. Further, the mass of the ejected drop in test case (b) was 13.2 pL. As such, the stepped nozzle (test case (b)) ejected a drop larger and faster than the drop ejected by the nozzle of test case (a). As such, the test cases (a) and (b) show that both drop mass and drop speed are dependent values upon the diameter of the utilized stepped nozzle.

FIGS. 4A-4F are graphs depicting the speed of an ink drop ejecting from a stepped nozzle. The results presented in FIGS. 4A-4F were obtained when a 200 Volt square wave, 6 us long, was applied to an electrostatic inkjet actuator. The ejecting drops were modeled using the commercially available CFD code, Flow3D. Six test cases, (a)-(f), as respectively depicted in FIGS. 4A-4F, were conducted, and which all utilized a stepped nozzle, similar to the stepped nozzle as depicted in FIG. 2, having an exit diameter of 25 μm. Test case (a) utilized an entrance diameter of 25 μm, test case (b) utilized an entrance diameter of 30 μm, test case (c) utilized an entrance diameter of 35 μm, test case (d) utilized an entrance diameter of 40 μm, test case (e) utilized an entrance diameter of 45 μm, and test case (f) utilized an entrance diameter of 50 μm. In all test cases (a)-(f), the length of the stepped nozzle was 25 μm. The vertical scale bars in all test cases depict the speed of the ejected drop after passage through the stepped nozzle with respective entrance diameters.

As shown in test cases (a)-(f), the drop speed increased as the entrance diameter increased. As such, the test cases (a)-(f) indicated that the speed of an ejecting drop was increased as the entrance diameter of the respective stepped nozzle was increased.

Fabrication of the nozzle plate 230 can be according to whether the nozzle plate is a polymer nozzle plate or a silicon nozzle plate. The nozzles (e.g. 250) in polymer nozzle plates are typically made by laser ablation, focusing a high-intensity laser beam through a photomask onto the polymer surface, vaporizing the desired areas in pulsed steps. The etch depth is controlled by the number of steps and/or the laser power. To create a stepped nozzle profile, the polymer nozzle plate can be etched with two different masks, either both from the same side, or one from the front and the other from the back. Because the holes are typically slightly tapered with the laser-ablated side wider, etching both steps from the nozzle entrance side is likely preferred, since that is usually the direction of taper that gives the best jetting performance.

The nozzles in silicon nozzle plates are typically created with deep reactive ion etching (DRIE), using energetic plasma to selectively etch vertical holes in the silicon. However, silicon can also be etched using anisotropic wet etching, which selectively attacks only certain crystal planes of the silicon. The timed wet etch can create a larger nozzle entrance. Use of a wet etch instead of DRIE can create sloped sidewalls which allow photoresist to flow down into the hole, allowing further lithography in the next step (exit portion of nozzle). This can be more difficult with DRIE's vertical sidewalls, requiring much thicker photoresist to get proper step coverage, and can be more difficult to achieve accurate nozzle patterning in thick photoresist.

While the invention has been illustrated with respect to one or more exemplary embodiments, alterations and/or modifications can be made to the illustrated examples without departing from the spirit and scope of the appended claims. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items, such as, for example, "one or more of A and B," means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An inkjet printhead comprising:

a substrate;

an electrostatically actuated diaphragm formed on the substrate; and a nozzle plate mounted to the substrate to define an ink cavity between the substrate and the nozzle plate, the nozzle plate comprising a silicon on insulator structure and a stepped nozzle formed therein, wherein the silicon on insulator structure comprises a silicon dioxide layer arranged between a first layer of silicon and a second layer of silicon, wherein each the first layer of silicon and the second layer of silicon is about 12.5 μm thick and the nozzle plate is about 25 μm in overall thickness, wherein the diaphragm is flexed to apply pressure to ink disposed in the ink cavity to force the ink through the stepped nozzle, and wherein the stepped nozzle comprises:

an exit diameter configured to control a mass of an ink drop, wherein the exit diameter is about 25 μm;

an entrance diameter configured to control, a speed of the ink drop independently from the mass of the ink drop, wherein the entrance diameter is in a range of about 35 μm to about 50 μm;

a first section defined by sloped sidewalls, wherein the entrance diameter is an outer surface of the first section; and a second section defined by sloped sidewalls, wherein the exit diameter is an outer surface of the second section, the first and second sections being aligned.

2. The printhead of claim 1, wherein the printhead is configured to receive ink from an ink supply means.

3. The printhead of claim 1, wherein the printhead receives the ink via at least one ink carrying channel.

4. The printhead of claim 1, wherein the ink drop is formed in the stepped nozzle.

5. The printhead of claim 1, wherein the first section is anisotropically wet etched.

6. The printhead of claim 1, wherein the second section is anisotropically wet etched.

7. The ink jet printhead of claim 1, wherein the sloped side walls of the first section extend along the entire length of the first section.

8. The ink jet printhead of claim 1, wherein the sloped sidewalls of the second section extend along the entire length of the second section.

* * * * *